US007261039B1

(12) United States Patent
Bittle et al.

(10) Patent No.: US 7,261,039 B1
(45) Date of Patent: Aug. 28, 2007

(54) ARTILLERY ROCKET KINETIC ENERGY ROD WARHEAD

(75) Inventors: David A Bittle, Somerville, AL (US); Gary T Jimmerson, Athens, AL (US); Julian L Cothran, Arab, AL (US); Donald H Blaise, Freeport, FL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/279,027

(22) Filed: Apr. 7, 2006

(51) Int. Cl.
*F42B 12/60* (2006.01)

(52) U.S. Cl. ..... 102/489; 89/1.14

(58) Field of Classification Search ..... 102/489, 102/473, 518, 293; 89/1.14, 1.11, 1.1
See application file for complete search history.

(56) References Cited

U.S. PATENT DOCUMENTS 3,881,416 A 5/1975 Dilworth
3,956,990 A 5/1976 Rowe
3,980,019 A 9/1976 Anderson et al.
4,649,825 A 3/1987 Quick et al.
5,094,170 A * 3/1992 Raynaud et al. ..... 102/489
5,445,078 A 8/1995 Marion
6,540,175 B1 4/2003 Mayersak et al.
6,920,827 B2 * 7/2005 Llyod ..... 102/497
6,957,609 B2 * 10/2005 Ronn et al. ..... 102/489

OTHER PUBLICATIONS

Federation of American Scientists, "Hydra-70 Rocket System", pp. 1-12, May 5, 2000; http://fas.org/man/dod-101/sys/missile/hydra-70.htm.

* cited by examiner

*Primary Examiner*—James S. Bergin

(57) ABSTRACT

A KE rod warhead for artillery rockets contains a multiplicity of KE rod penetrators housed in trays and packaged into bays or tier packs that are stacked and positioned around a center column of the warhead. The warhead has a skin which is severed upon the rocket entering a target area. The KE rods are situated and housed in such a manner that upon release the rods experience a minimum of pitching or tumbling upon entering the air stream giving the rods an optimal lethality against a designated target. The KE rod artillery rocket contains no explosive munitions, so it can be used without civilian and environmental concerns over unexploded ordnance.

7 Claims, 4 Drawing Sheets

ARTILLERY ROCKET KINETIC ENERGY ROD WARHEAD

DEDICATORY CLAUSE

The invention described herein may be manufactured, used and licensed by or for the Government for U.S. governmental purposes, provisions of 15 U.S.C. section 3710c apply.

BACKGROUND OF THE INVENTION

The prior art for artillery rocket lethal warhead packaging includes unitary high explosive bombs, autonomous or semi-autonomous submunitions designed to attack armor, and anti-personnel payloads comprised of hundreds of fragmenting, explosive filled cluster munition bomblets. In order to construct the cluster munition warheads, cylindrical cluster munitions are installed into longitudinal holes in large cylindrical foam overpacks. Multiplicities of overpacks are installed into longitudinal holes in large cylindrical foam overpacks.

The rocket dispenses its payload by means of an explosive bursting charge in the warhead bay that splits the warhead skin along pre-scored longitudinal lines, disintegrating the cylindrical foam overpacks and scattering the cluster munitions into the air stream around the rocket. The explosive bursting charge is black powder contained in a plastic cylinder that extends the entire length of the warhead bay. The artillery rocket payload dispense event is extremely violent and energetic, since the burster must rip apart the metal warhead skin and widely disperse the payload of cluster munitions.

Kinetic energy (KE) rods have been used in the past in artillery shells and in small direct fire rockets, but never in an indirect fire artillery rocket. The prior art artillery shells used a large number of extremely small rods that were dispensed by a central bursting charge for effect within a short distance of the dispense point. The rods lost velocity and effectiveness very quickly due to their low mass and random orientation dispense method.

The aforementioned direct fire rockets utilized an explosive charge behind the rod payload cavity to dislodge the warhead nose and to dispense the single cluster of KE rods into the air stream ahead of the rocket body. Neither of these techniques is applicable for use in an indirect fire artillery rocket.

KE rods are currently fielded in a US Air Force delivered dispenser weapon system. However, this weapon operates in a much lower velocity regime than a supersonic artillery rocket; thus, its payload dispensing system is not applicable to the present invention.

No currently utilized munition packaging techniques are appropriate for use with artillery rocket KE rod payloads. If the rods are placed directly into the rocket warhead bay, they are dispensed in random orientations and quickly lose their velocity and lethality due to air drag. Installing them into foam packs and then installing the foam packs one at a time into the rocket is labor intensive. Additionally, the explosive forces needed to break up the foam packs and expel the rods from the rocket would cause many rods to be damaged during dispense. Further, many rods would be dispensed in random with ineffective orientations. This foam-pack arrangement would tend to dispense the rods as large numbers of tightly packed small clusters. These clusters would be dispensed along an axis several feet in length, so that the poorly oriented rods and random foam fragments from the forward clusters would be likely to have fratricidal impact with one another. Thus, the effectiveness of the warhead payload would be severely degraded.

SUMMARY OF THE INVENTION

The present invention includes a novel packaging arrangement specifically designed for KE rod rocket payloads, which along with a new payload dispensing technique, yields benefits in both assembly cost and in terminal performance. Assembly costs are reduced because the laborious task of filling the foam packs with KE rod packs is eliminated. All of the KE rods are pre-assembled into wedge-shaped packs (holding trays) that are inserted as units into the rocket warhead bay.

Once the wedges of rods are in place, they are secured by a retaining band that is severed during the skin severance event. The technical performance of the warhead is improved because the tightly packed rods can be dispensed in a well-defined radial ejection event that minimizes perturbations to their angular orientation. The tightly packed rods are easily loaded to contact the flat surface of the tier pack bulkhead and are then secured together by the wrap-around restraining strap. Additionally, no packing material or dunnage is used between the rods, so that dunnage fragments cannot damage the rods or disturb their orientation during dispense.

The result is a KE rod cloud that forms a predictable and repeatable expanding elliptical pattern over the target area. Holes in the rod cloud and fratricide between KE rods are thus minimized.

DETAILED DESCRIPTION

Figure 1:
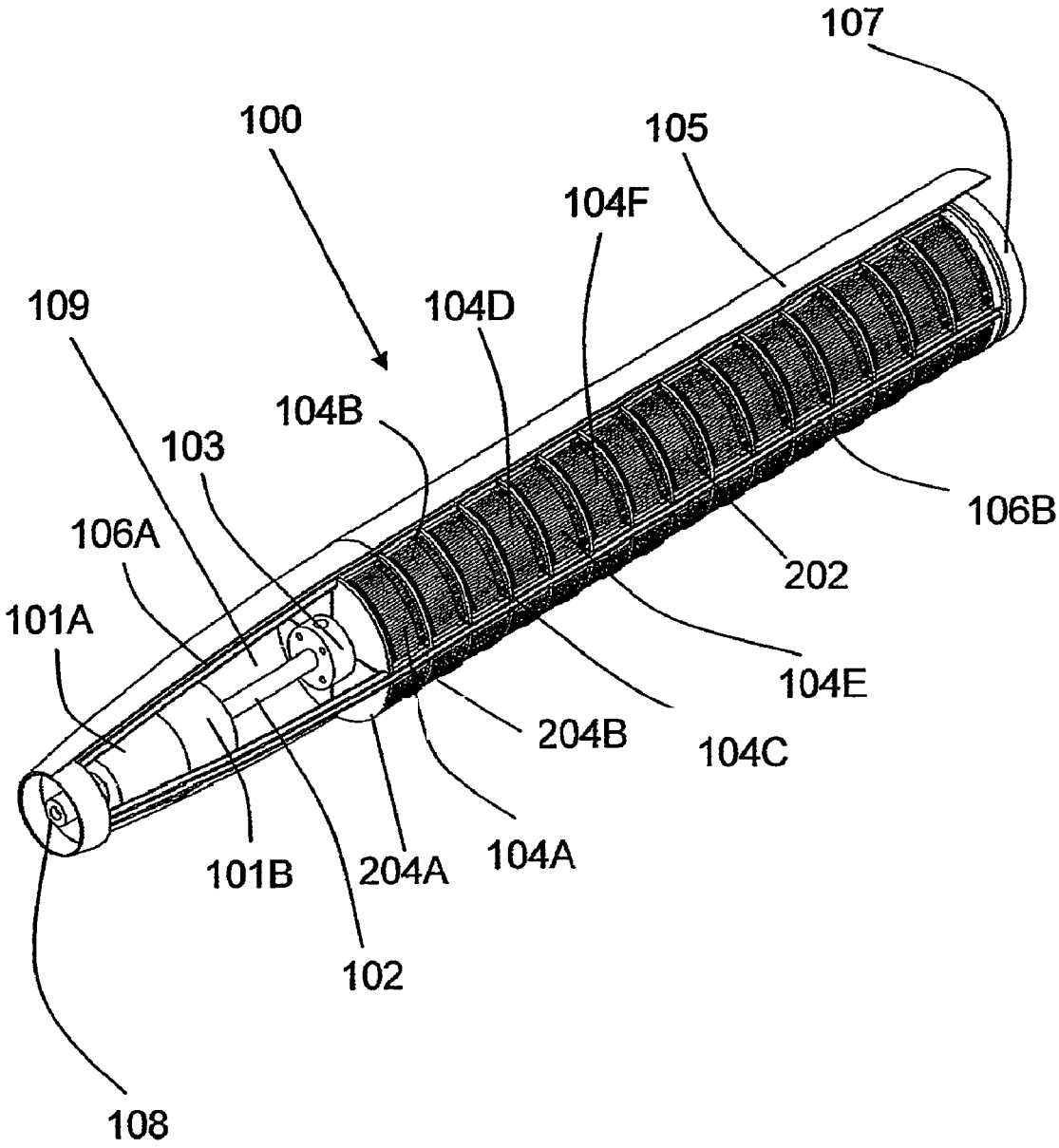
FIG. 1 is a cutaway view of the KE rod payload assembly of the present invention.

In FIG. 1, in warhead 100 the KE rods 202 are visible in that the straps and donnage over the KE rod packs or tier packs 104 have been removed. The forward portion of the warhead bay 109 contains ballast weights 101A and 101B that tailor the mass, center of mass location and inertia properties of the rocket. The ballast weights are designed to ensure that the overall mass and inertia properties of the KE rod payload matches the prior art cluster munition payload, so that no changes will be required in the prior art trajectory simulations and firing tables. A rocket center column 102 runs down the center of the warhead bay. The rocket center column 102 serves as the attachment point for the ballast weights 101A, 101B, the warhead bay bulkhead collar 103, and the stages of tier packs 104A, 104B, 104C, 104D 104E, 104F, etc. Tier pack 104A is situated between bulkhead 204A and Bulkhead 204B. The KE rods or flechettes 202 are tightly nested together in a multiplicity of tier packs inside the artillery rocket warhead bay.

The present invention utilizes a KE rod payload concept such that the skin severance system is separated from the rod distribution function so that each can be optimally calibrated for its intended purpose. The warhead skin 105 is separated from the artillery rocket just prior to dispense of the KE rods.

Skin severance trays 106 containing flexible linear shaped charge (FLSC) lines 305 are placed at four equally spaced radial locations just beneath the warhead skin. The FLSC lines (FIG. 3) are initiated by a conventional rocket fuze that severs the warhead bay skin away from the rocket. Inflatable gas bags can be placed beneath the skin panes to initiate their separation from the rocket body, if so required by the aerodynamics of the particular implementation. The bags are required in some cases to ensure that the skin panels do not strike the rocket body or tailfins after severance. In most applications, the rocket spin rate is sufficient to discard the skin panels and the gas bags are not necessary.

Figure 2:
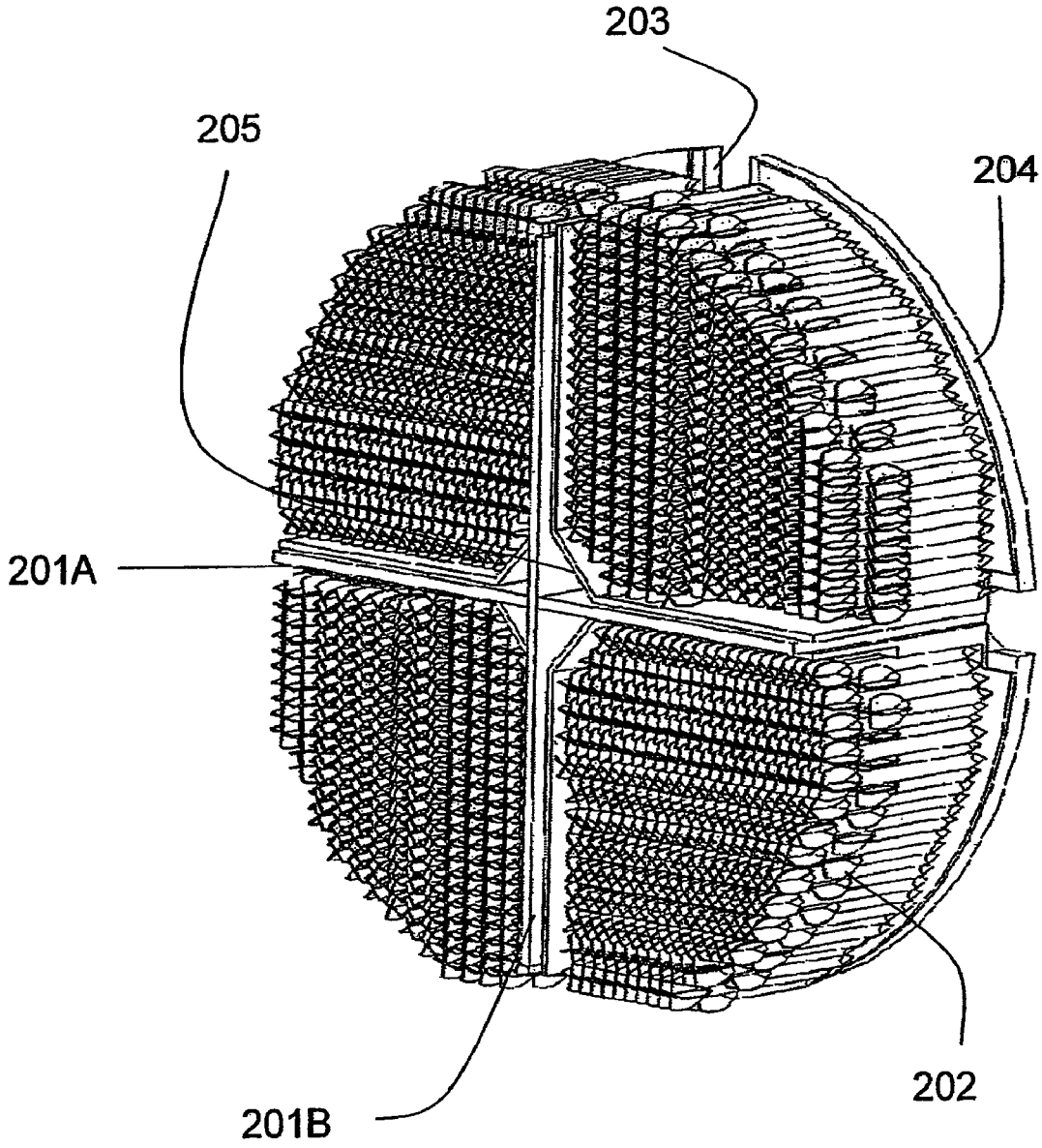
FIG. 2 is a perspective illustration showing one of the multiplicity of tier packs packed into an artillery rocket warhead bay according to the present invention.

In FIG. 2, one of the multiplicity of tier packs is packed into the artillery rocket warhead bay. The tier pack is divided into quadrants, with quadrant dividers 201A, 201B between them. KE rods 202 are tightly packaged together into tier pack trays 205 separated by the quadrant dividers with all the rods pointing forward toward the nose of the artillery rocket. All of the tier pack bulkheads 204 have cutout areas 203 for attachment to the skin severance trays 106. The distance between bulkheads is slightly greater than the rod length, so that the rods can be dispensed from the rocket without dragging against the bulkheads.

Figure 3:
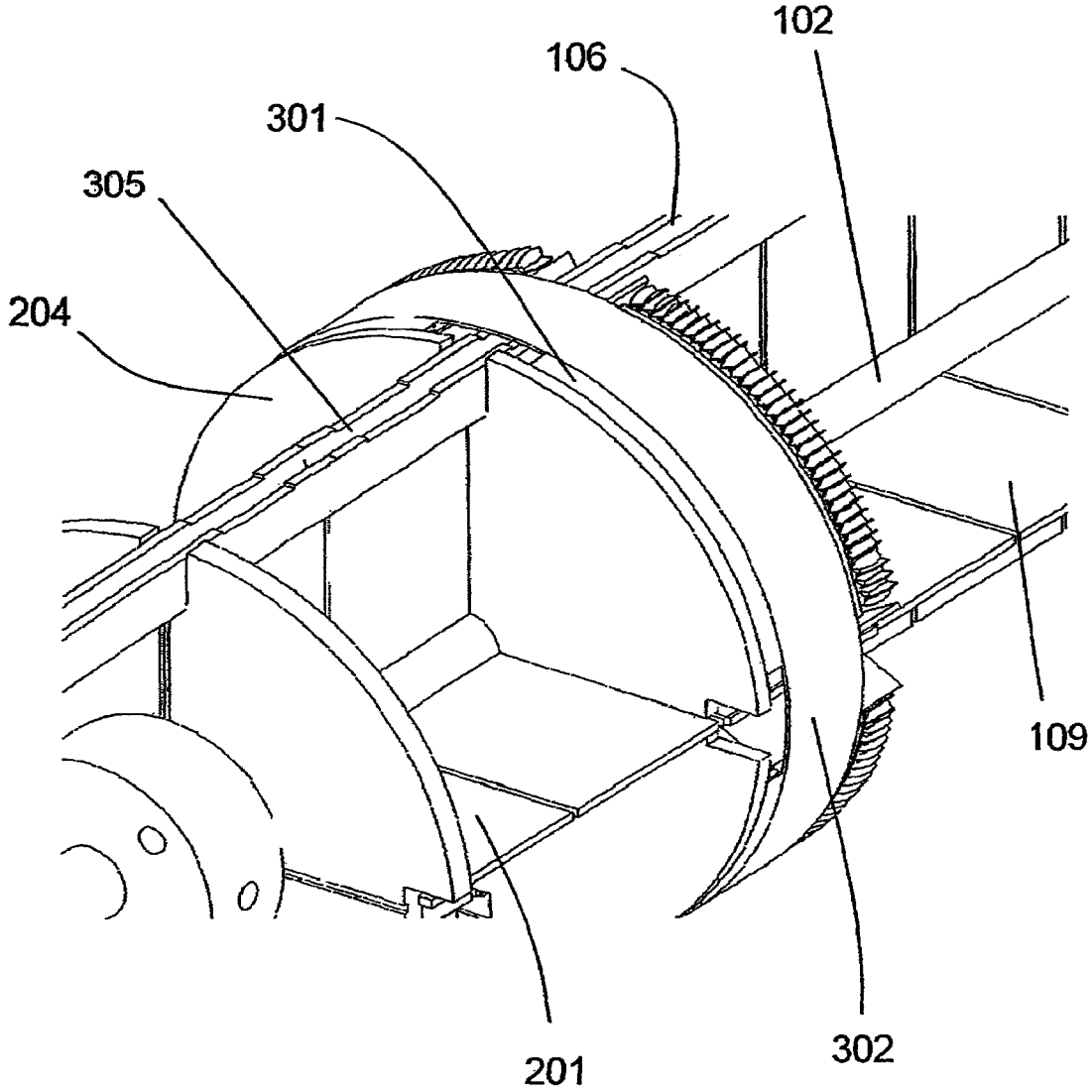
FIG. 3 is a perspective illustration of one of the tier packs according to the present invention completely assembled into the warhead bay.

In FIG. 3, one of the tier packs is completely assembled into the warhead bay 109. The flexible dunnage 301 prevents damage to the rods caused by skin contact during transportation and handling of the rocket. The retaining strap 302 wraps around the tier pack and passes over the skin severance trays. Retaining strap 302 compresses the tier packs so that the rods do not vibrate or chafe against each other during transportation and handling of the rocket or during flight.

Operation of the FLSC when the warhead skins are cut separates the restraining strap into four pieces and releases the rods from the rocket. The KE rod warhead utilizes the spin rate of the rocket to dispense the rods from the warhead and disperse them into the airstream without excessive pitching or tumbling The dispense technique, in conjunction with the nose-forward packaging arrangement and the incorporation of multiple rows of tiers of rods, ensures that a dense and repeatable pattern of rods is delivered to the artillery rocket target area.

The present invention provides that different tier packs can contain different sizes of KE rods. Since each type and size of rod is effective against a defined range of targets, constructing the payload from a mix of rods yields excellent broad spectrum lethality for the overall payload. Conversely, constructing payload assemblies from a single type of rods gives optimized lethal results against more narrowly defined target sets. The present invention can contain both homogenous and heterogeneous arrangements of KE rod configurations.

With reference to FIG. 1, the major structural components of the artillery rocket KE rod warhead are the center column 102, the skin severance trays 106A, 106B, etc., and the warhead skin 105. The components are rigidly attached to the warhead bay forward bulkhead 108 and the warhead bay aft bulkhead 107. The reinforcement provided to the assembly by the bulkheads and center column ensures that it will withstand all ground handling and flight loading conditions. The ballast weights 101 are rigidly attached to the center column 102 and are adhesively bonded into the ogive (conical head) section of the warhead skin.

Figure 4:
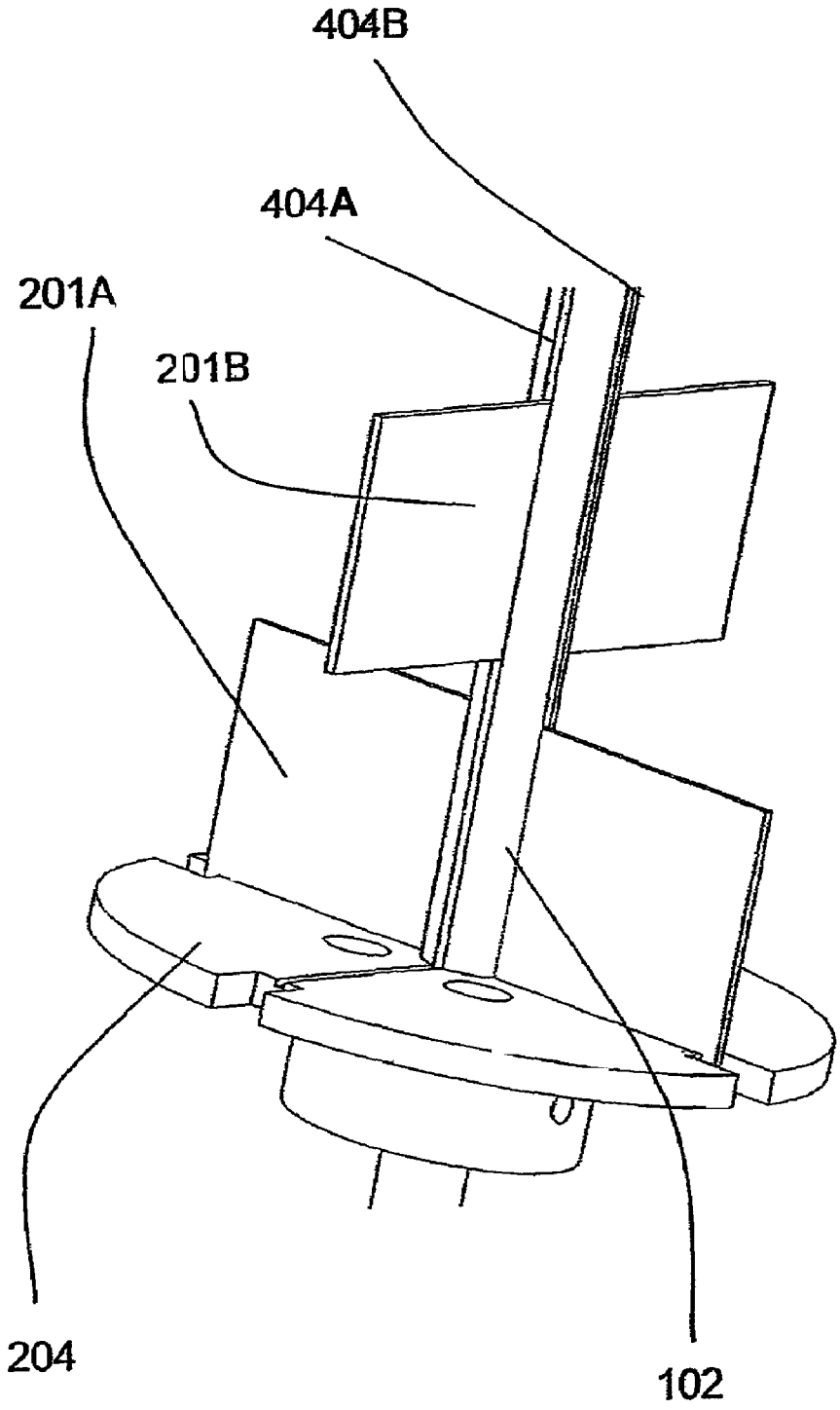
FIG. 4 is a perspective illustration showing how the quadrant dividers, and tier pack bulkheads are assembled on the rocket center column according to the present invention.

In FIG. 4, the warhead bay quadrant dividers (tier pack dividers) 201A, 201B and tier pack bulkheads 204 are assembled onto the center column 102. The center column has longitudinal slots 404A, 404B to allow the tier pack dividers to be placed into position. The tier pack bulkheads are not attached to the warhead skin. The skin severance trays 106 fit within cutouts 203 in the tier pack bulkheads. and are securely attached to them. The skin severance trays are securely attached to the tier pack bulkheads and to the forward and aft warhead bay bulkheads. In addition, the skin severance trays hold the FLSC lines in close proximity to the warhead skin in the locations where the skin is to be cut. Finally the KE rods are packed into the tier pack quadrants as shown in FIG. 2 and FIG. 3 using the flexible dunnage material 301 and restraining strap 302 to hold them securely in position. All of the KE rods are packaged in a nose-forward orientation.

All the components with the exception of the FLSC, KE rods and flexible dunnage can be constructed from either aluminum or corrosion resisting steel as required for their specific strength and weight properties. The FLSC lines are energetic pyrotechnic devices. The KE rods can be constructed from steel or tungsten, depending upon the loadout that best addresses the full target set for the rocket. The flexible dunnage can be made from any type of currently available protective packaging material.

The operation cycle begins when an artillery rocket carrying a KE rod payload enters its target areas and its fuze initiates the payload dispense event. The artillery rocket fuze initiates the FLSC lines contained in the skin severance trays 106. The FLSC severs the skin longitudinally into four panels and cuts the KE rod pack restraining straps 302. The spin of the rocket throws the panels away from the rocket body so that they do not strike either the rocket airframe or the tailfins.

The removal of the warhead skin and severance of the restraining straps frees the KE rods from their tier packs. The KE rods are then ejected away from the rocket by the centripetal acceleration resulting from the rocket spin rate. Dispense of the KE rods in this way results in them entering the air stream with a minimum of pitching or tumbling. The completion of the operation cycle occurs when a dense and repeatable pattern of KE rods engages the artillery rocket target area.

In prior art artillery rockets, when the rocket was used against a target, large numbers of cluster munitions were scattered in and around the target area. Typically some of the munitions failed to explode making the area hazardous to friendly troops and to civilians for an indefinite period of time. Use of the cluster munitions has drawn increasing international criticism, with some organizations and countries advocating complete bans on cluster munitions. A further drawback of prior art artillery rockets is that they have limited effectiveness against certain types of targets.

In the present invention, the artillery rocket target area is attacked with a lethal and effective pattern of KE rod penetrators that leave no unexploded ordnance (UXO) or environmental contamination after the attack. Thus, friendly troops can enter the target area without danger, and civilians in the area can pursue their daily activities without the lingering danger of injury or death from UXO hazards. Plus, no battlefield cleanup costs will be incurred by the United States Government from the use of these artillery rockets.

Still further, in the present invention, the KE rod payload has broad spectrum effectiveness against most artillery rocket targets. Its lethality against the target is equal to or greater than the prior art cluster munition payload, and it can be used without incurring condemnation from the international community.

Modifications of the above teachings are possible without deviating from the spirit of the present invention. Accordingly, the scope of the invention is limited only by the claims which follow hereafter.

What is claimed is:

1. An artillery rocket warhead comprising:

a forward bulkhead;

an aft bulkhead;

a center column extending from the forward bulkhead to the aft bulkhead;

a plurality of longitudinal supports extending rearward from the forward bulkhead and being positioned radially outward of said center column to define a warhead bay area;

a plurality of tier bulkheads positioned between the forward bulkhead and the rear bulkhead so as to form a plurality of tiers, said plurality of tier bulkheads being connected to and positioned within said plurality of longitudinal supports;

a payload located within each tier of said plurality of tiers;

a restraining strap provided for each tier of said plurality of tiers, said restraining strap extending around said longitudinal supports and said payload;

a warhead skin connected to said forward bulkhead and surrounding said plurality of tier bulkheads, said plurality of longitudinal supports and said restraining strap;

a holding tray for holding said payload within said each tier of said plurality of tiers; and wherein said longitudinal supports are skin severance trays containing explosive for severing said warhead skin and said restraining strap.

2. An artillery rocket warhead according to claim 1, wherein:

said each tier of said plurality of tiers comprises a plurality of holding trays for holding said payload.

3. An artillery rocket warhead according to claim 2, wherein:

said plurality of holding trays in said each tier of said plurality of tiers are separated by dividers which connect to said center column.

4. An artillery rocket warhead according to claim 3, wherein:

said payload is a plurality of kinetic energy rods.

5. An artillery rocket warhead according to claim 3, wherein:

said holding trays are wedge shaped.

6. An artillery rocket warhead according to claim 5, wherein:

said explosive is a flexible linear shaped charge.

7. An artillery rocket warhead according to claim 3, further comprising:

a support collar connected to said center column for securing said tier bulkheads.

* * * * *